United States Patent [19]

Miller et al.

[11] Patent Number: 4,804,336

[45] Date of Patent: Feb. 14, 1989

[54] DOUBLE FIFTY PLUG-SOCKET CONNECTOR

[75] Inventors: Michael A. Miller, Burnsville; Robert A. Lidholm, Robbinsdale, both of Minn.

[73] Assignee: Magnetic Peripherals Inc., Minneapolis, Minn.

[21] Appl. No.: 107,233

[22] Filed: Oct. 9, 1987

[51] Int. Cl.[4] ..... H01R 27/00

[52] U.S. Cl. ..... 439/218; 439/170

[58] Field of Search ..... 439/638–655, 439/660, 682, 684, 686, 688, 692, 693, 695, 709, 712, 714, 724, 170, 218

[56] References Cited

U.S. PATENT DOCUMENTS

| | | | |
|---|---|---|---|
| 3,500,295 | 3/1970 | Faber et al. | 339/176 |
| 4,140,361 | 2/1979 | Sochor | 339/258 P |
| 4,285,562 | 8/1981 | Teagno et al. | 439/222 |
| 4,381,132 | 4/1983 | Tournier | 339/99 R |
| 4,444,451 | 4/1984 | Myers | 339/154 A |
| 4,568,136 | 2/1986 | Reüss | 339/176 M |
| 4,619,495 | 10/1986 | Sochor | 339/176 MP |
| 4,655,515 | 4/1987 | Hamsher, Jr. et al. | 339/14 R |
| 4,715,829 | 12/1987 | Preputnick | 439/660 |

OTHER PUBLICATIONS

"Amp Insert Rack and Panel Connectors", Amp. Inc., p. 40, Nov. 1959.

AMP Incorporated, "AMP In-Cert Rack and Panel Connectors", brochure, copyright 1959.

AMP Incorporated, "Engineering and Purchasing Guide, Fifth Edition", AMP Catalog No. 4507-1, copyright 1984, pp. 1, B65, B66, B94, B95, B106.

Page 16 of Mar.-Apr. 1987 Digi-Key Corporation Catalog. Digi-Key Corporation, P.O. Box 677, Thief River Falls, MN 56701.

*Primary Examiner*—David Pirlot

*Attorney, Agent, or Firm*—Robert M. Angus; Joseph A. Genovese

[57] ABSTRACT

A double density plug and socket electrical connector employing the same form factor as existing 50 pin subminiature "D" connectors. Adapted for use on printed circuit boards the connector can compatibly interconnect 50 pin or 100 pin electrical connectors. The double fifty plug-socket connector can carry a multiple byte wide SCSI bus.

12 Claims, 3 Drawing Sheets

DOUBLE FIFTY PLUG-SOCKET CONNECTOR

BACKGROUND OF THE INVENTION

The invention relates generally to a plug and socket electrical connector, and more particularly, to connectors for printed circuits having a socket type spring contact strip and a plug type terminal strip insertable into the socket.

In view of the continuously progressive miniaturization of apparatus and components in electrical communications and transmission engineering, the construction of plug and socket connections becomes of constantly increasing importance, particularly with respect to increasing the number of electrical connections while maintaining or reducing the physical dimensions of the connector. A typical plug and socket connector for printed circuit boards is of the D-shaped type which provides the proper orientation of the plug into the socket. An example of an electrical connector is shown in U.S. Pat. No. 3,500,295 to Faber et al., wherein a plug and socket connector adapted for use on printed circuit boards is shown. The teachings of this patent are incorporated herein by reference.

As printed circuit boards become more complex embodying multiple layers within a board, the multiplicity of connections needed for communication with the printed circuit board increases while the area available on the board for placement of components and connectors is reduced. Typical D-shaped connectors are of a small size and are called subminiature D-shaped electrical connectors. These connectors carry up to a maximum of 50 electrical contacts. For electrical communication between computer equipment and peripherals a communications bus protocol is needed. One such protocol authorized by the American National Standards Institute (ANSI) is the Small Computer Systems Interface (SCSI). There is a growing interest within the industry for a connector that can provide more than a one byte wide SCSI bus while remaining within the same form factor or physical dimensions of an existing subminiature D-shaped 50 pin connector. It is desirable to maintain both upward and downward compatibility between connectors of existing and new designs. The needs expressed above lead to the creation of the connector of the present invention.

OBJECTS OF THE INVENTION

Accordingly, one object of this invention is to provide a 100 pin version of a plug and socket connector suitable for carrying more than a one byte wide SCSI bus while retaining the form factor of an existing subminiature D-shaped 50 pin connector. The 100 pin connector of the present invention possesses the physical outer dimensions of a subminiature D-shaped 50 pin connector while doubling the electrical contacts made within the same spacing as the 50 pin connector. The electrical contact width of a 50 pin connector is roughly halved by adding a space or spacer which is located between the reduced width contacts. To provide an electrical contact to the increased number of pins, a staggering of the pin connections to the contacts is made which allows for a crimped wire or other connection to the electrical contact posts.

The new connector provides compatibility between a 100 pin connector and a 50 pin connector thereby satisfying the ANSI requirements for downward and upward compatibility of electrical parts. Some of the 100 pin connections can be used to determine whether the 100 pin connectors is mating with another 100 pin connector, or mating with only a 50 pin connector.

The 100 pin connector of the present invention allows one part to be stocked in place of having two. The form factor, that is the physical space used upon a printed circuit board, remains the same as with a 50 pin connector.

DESCRIPTION OF THE PREFERRED EMBODIMENTS

Figure 1:
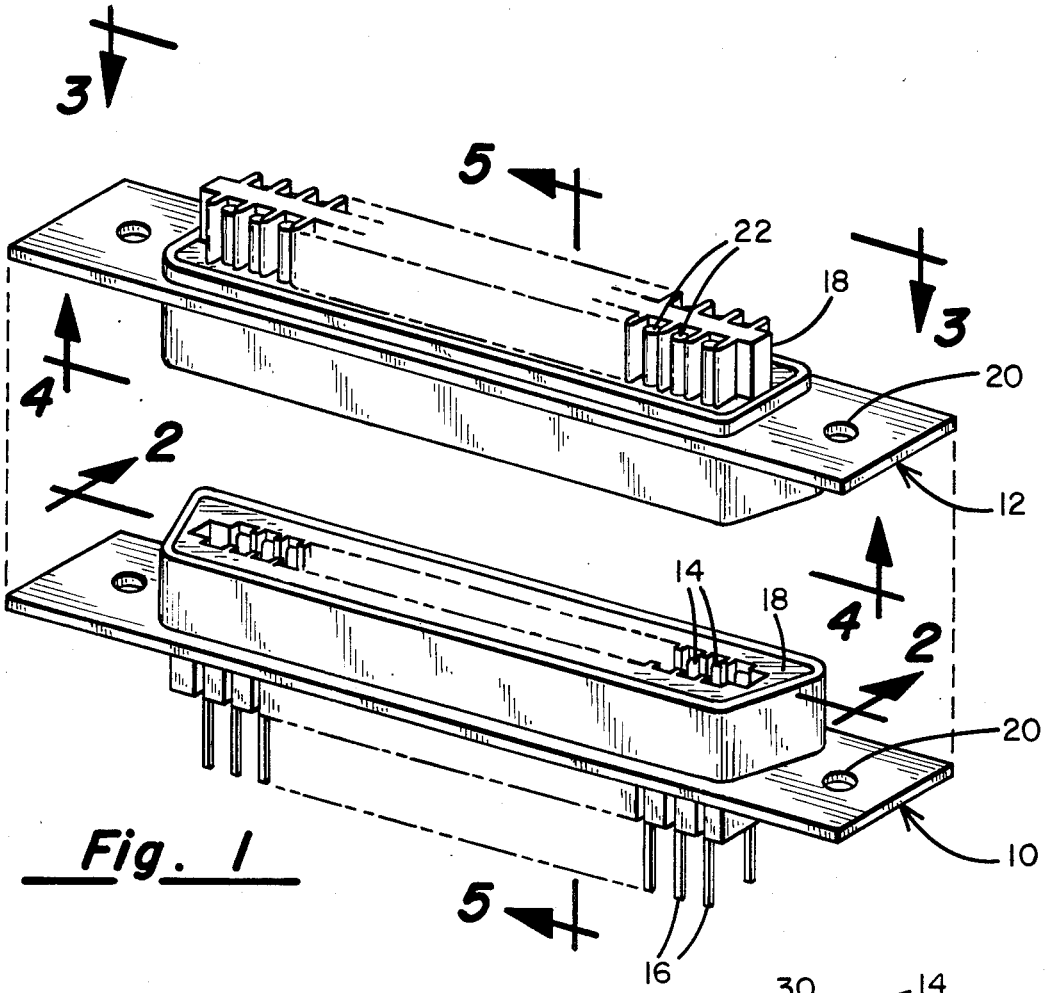
FIG. 1 is a isometric view of a D-subminiature plug and socket electrical connector.

Shown in FIG. 1 is a D-shaped subminiature plug-socket connector. Socket 10 is a unitaried body and can be made up of materials such as steel with zinc plating. Likewise, plug position 12 is of one piece construction and is designed to complementary engage with socket 10. The metallic housing is the support structure for the electrical connector. Electrical contacts 14 are spaced along the length of the electrical socket and can be made of a base material of beryllium copper and can have a plating of nickel-gold to decrease resistance across the contact junction. A thermoplastic type of material such as liquid crystal polymer or equivalent 18 provides for a dielectric separation between the housing 10 and the contacts 14. A electrical connection can be made to contacts 14 through wires 16 which are designed to mount directly to a PC board. Alternatively, socket 10 could connect to electrical wire connections rather than a PC board. The male plug portion of the electrical connector has posts 22 which are designed to connect to electrical wire cable such as a ribbon cable or a discreet wire bundle. The posts feed through to electrical contacts in the male plug which is not shown in this view.

The wire cable can be 50 pairs of 28 gauge wire forming a bundle of approximately ½ inch diameter. The cable must be highly flexible. Such cable is available from Madison Cable, 125 Goddard Memorial Dr., Worchester, MA 01603.

Holes 20 can be used to attach the plug to the socket or for attachment to a printed circuit board. A bail type latch not shown could also be employed on the connector.

Figure 2A:
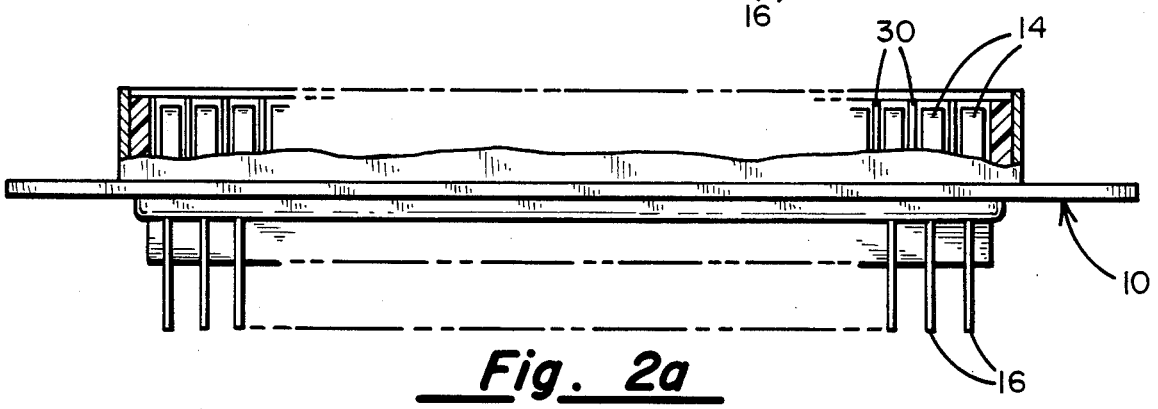
FIG. 2*a* is a sectional view of a connector socket.
Figure 2B:
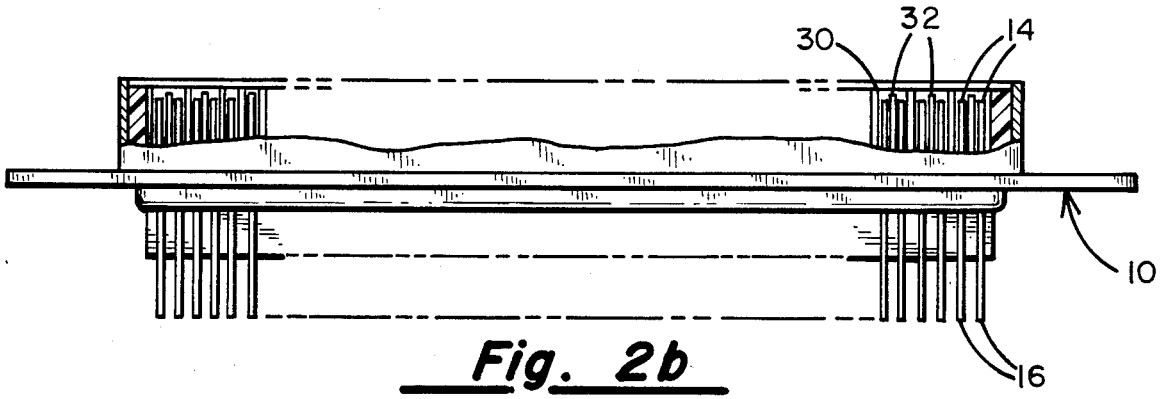
FIG. 2*b* is a sectional view of a connector socket according to the present invention.

The present invention places two electrical contacts within the same linear spacing as one contact of the existing subminiature D-shaped design. This is shown in FIGS. 2*a* and 2*b*. To maintain the lateral separation between the contacts 14 in the old design, a spacer 30 is placed therebetween. The spacers 32 between the narrow contacts pairs in the 100 pin connector of the present invention do not extend as far as the larger spacers 30 of the old design. Therefore, electrical connection can be made between a 50 pin old style plug mating with the 100 pin socket of the present invention.

Figure 3A:
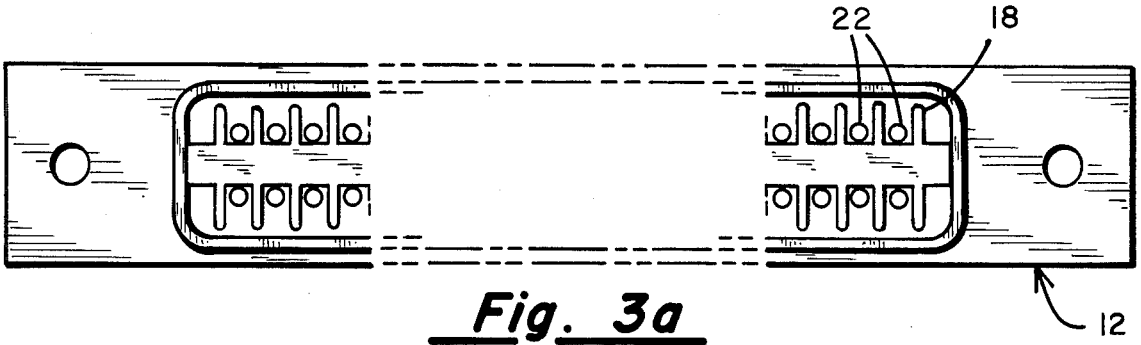
FIG. 3*a* is a top view of the plug portion of a connector.
Figure 3B:
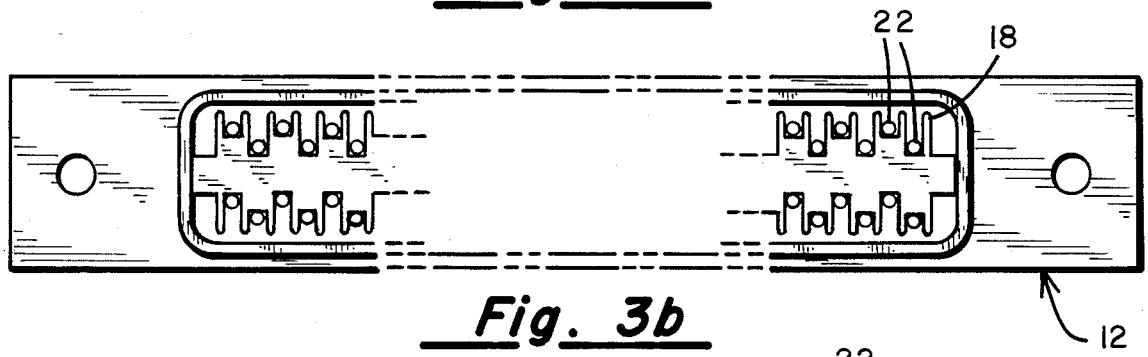
FIG. 3*b* is a top view of the plug portion of the connector of the present invention.
Figure 3C:
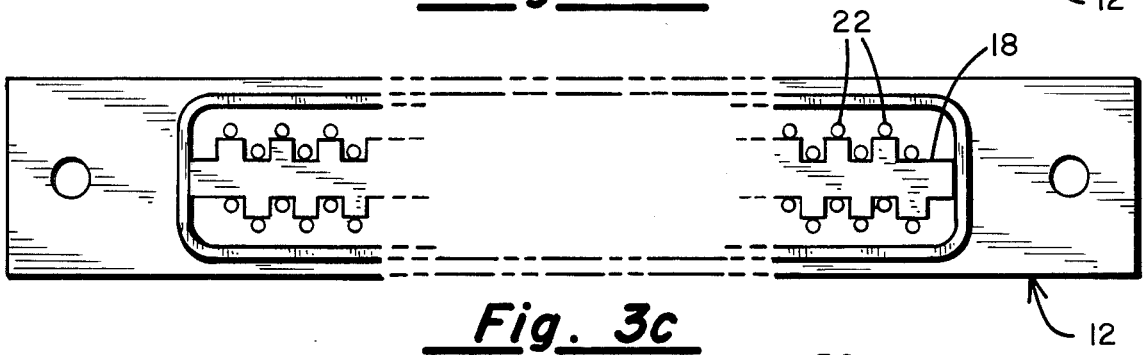
FIG. 3*c* is a top view showing an alternative embodiment of the plug portion of the connector according to the present invention.

Making effective electrical connection to the male plug portion of the electrical connector can be very difficult. Whether using a ribbon cable or a discrete wire bundle, it is often desirable to connect the cable to the contact post of the male plug without the use of solder. Due to the increased number of contacts necessary to be made for the present invention, staggered arrangement as shown in FIG. 3*b* is used. This arrangement is in contrast with the straight line post connections in of the subminiature D-shaped connector shown FIG. 3*a*. FIG. 3*a*, shows the posts 22 which are circular in shape. The posts may have widened areas for crimping onto electrical connective wire. Thermoplastic 18 separates each contact post. An alternative embodiment is shown in FIG. 3*c* where no thermoplastic material is used to separate the posts, separation being provided by the staggered relationship of adjacent posts. This provides easy access to the posts for crimping.

Figure 4A:
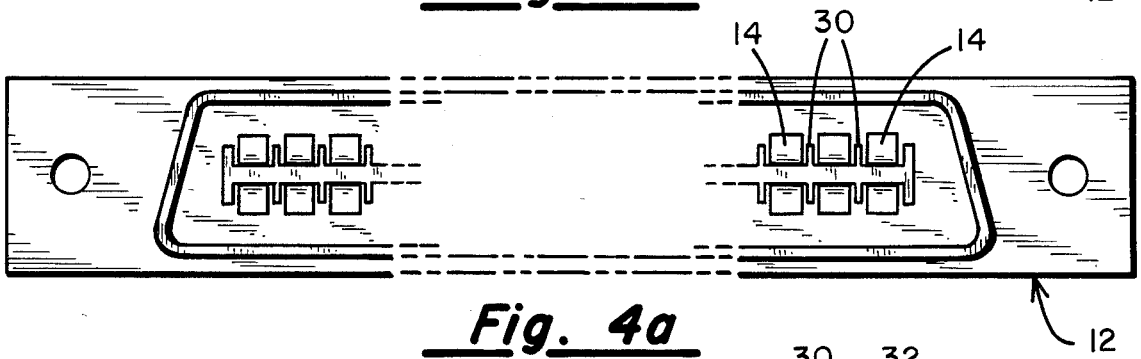
FIG. 4*a* is a bottom view of the plug portion of a connector.
Figure 4B:
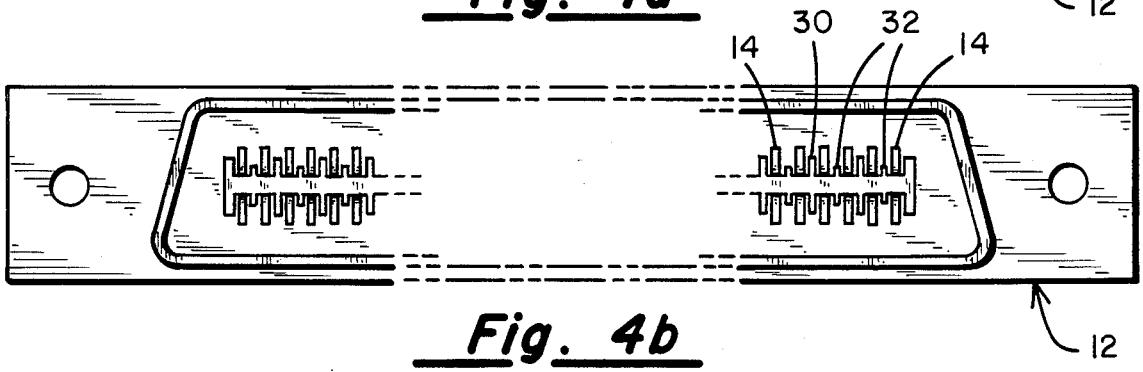
FIG. 4*b* is a bottom view of the plug portion of the connector according to the present invention.

In the cross sectional view of FIG. 4*a* which is taken looking upward, the male plug portion of a subminiature D-shaped 50 pin connector is contrasted with that of the 100 pin connector of the present invention, which is shown in FIG. 4*b*. As seen in 4*a*, contacts 14 is separated by thermoplastic spacers 30 which extends outward nearly as far as the contacts. In FIG. 4*b*, each pair of contacts 14 are separated by large spacers 30 which protrude outward from the center of the plug nearly as far as the contacts while each individual contact in separated by spacer 32 of the same thermoplastic material 18. Spacers 32 do not extend from the center line of the plug as far as the large spacers 30. The two figures show how the 100 pin connector of the present invention can mate with a 50 subminiature D-shaped pin connector of the known art.

Figure 5:
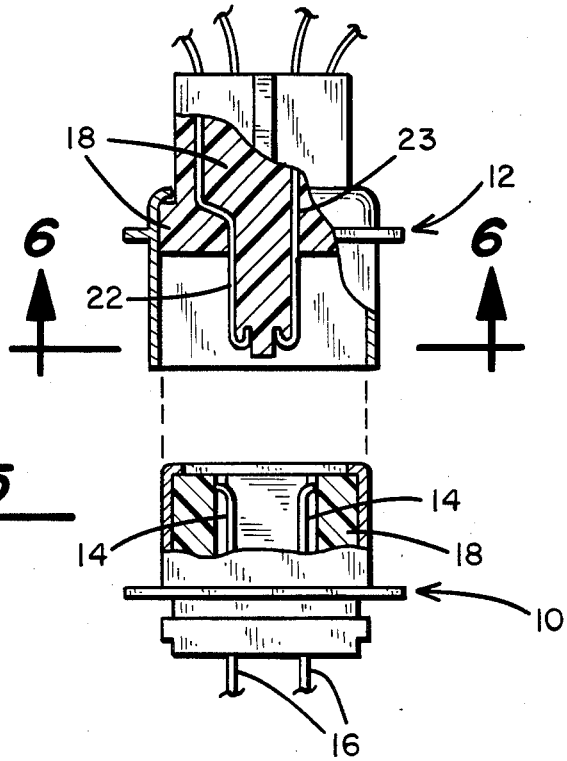
FIG. 5 is a sectional end view of a plug and socket connector according to the present invention.

A cross sectional view of the unmated electrical connector is shown in FIG. 5. The socket portion 10 contains contacts 14 and electrical leads 16 having a dielectric encasement of thermoplastic material 18. The plug portion 12 has posts 22 and 23 leading in through the thermoplastic material 18 as shown. It can be seen that post 22 in FIG. 5 has a L-shaped, whereas post 23 does not. This is because of the staggered configuration of the electrical wire post contacts on the plug portion of the electrical connector. Every other post will be of the type having an L-shaped as depicted by numeral 22. It is desirable that the unique L-shaped posts be easily loaded into the plug or socket by conventional means to promote manufacturability of the connector.

Figure 6A:
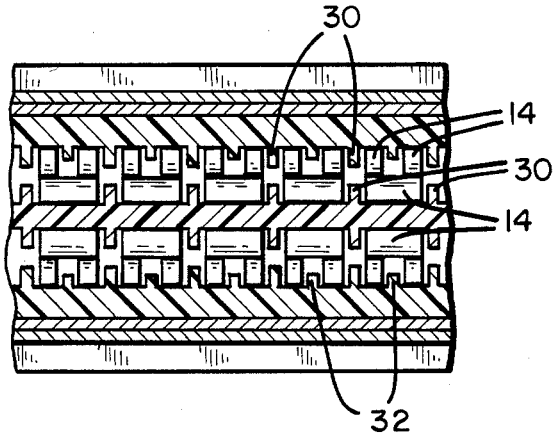
FIG. 6*a* is a partial sectional view of a mated subminiature D-shaped 50 pin plug with the socket of the present invention.
Figure 6B:
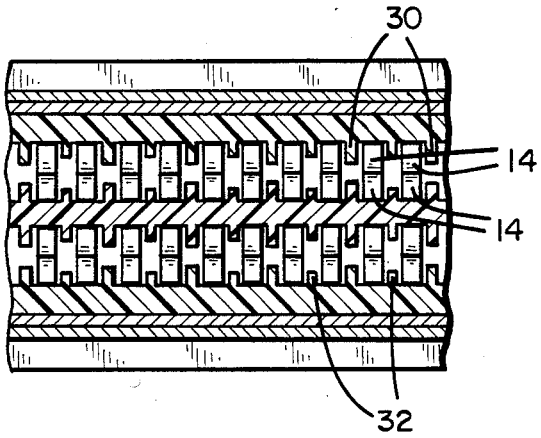
FIG. 6*b* shows the mated plug and socket of the present invention.

A schematical representation showing the uniqueness of the present invention can be seen in FIGS. 6*a* and 6*b*, which are partial sectional views taken along lines 6—6 of FIG. 5 showing the connector in an engaged position and rotated 90°. FIG. 6*a* shows a subminiature D-shaped 50 pin connector mated to a 100 pin connector of the present invention. Contacts 14 mate together being laterally separated by large spacers 30. On the 100 pin socket side small spacers 32 separate each contact while spacers 30 separate each set of two contacts. FIG. 6*b* represents a 100 pin plug to 100 pin socket mating of an electrical connector. Electrical contacts 14 of the male plug mate directly opposite of the electrical contacts 14 of the female socket with large spacers 30 and small spacer 32 separating each contact 14 of the 100 pin connector.

Changes may be made within the scope and spirit of the intended claims which define what is believed to be new and deserving of patent protection.

We claim:

1. A male plug connector of the miniature type, particularly adapted to mate with a female socket connector of the miniature type for use with printed circuit boards and the like, said male plug connector comprising: a plurality of plug-type contact elements in the form of electrically conductive sheet metal; an insulative support member rigidly supporting said contact elements in two groups, said support member forming an elongated relatively narrow support strip in which an intermediate portion of each contact element is rigidly embedded so that a terminal portion of each contact element is disposed at one side of said support strip and a contact portion of each contact element is disposed at an opposite side of said support strip, said support member further having a plug portion extending from said opposite side of said support strip, said plug portion aligning the contact portions of the contact elements of each of said groups; first spacer means extending from said plug portion for separating the contact portions of each group into pairs; and second spacer means extending from said plug portion for separating the contact portions of each of said pairs, said second spacer means extending from said plug portion by a distance less than said first spacer means; said male plug connector being adapted to mate with a female socket connector having the same number of contact elements as said male plug connector by establishing electrical connection between respective ones of the contact elements of the male plug connector and respective ones of the contact elements of the female socket connector, and being adapted to mate with a female socket connector having one-half the number of contact elements as said male plug connector by establishing electrical connection between respective pairs of the contact elements of the male plug connector and respective ones of the contact elements of the female socket connector.

2. Apparatus according to claim 1 wherein the terminal portions of the contact elements of each pair of contact elements are staggered along the length of said support member to form four rows of terminal portions.

3. Apparatus according to claim 2 further including a plurality of staggered lands supported on said one side of said support strip to stagger said terminal portions.

4. Apparatus according to claim 3 further including third spacer means between adjacent lands.

5. Apparatus according to claim 1 further including a female socket connector of the miniature type comprising: a plurality of socket-type second contact elements in the form of electrically conductive sheet metal; a second insulative support member rigidly supporting said second contact elements in two groups, said second support members forming an elongated relatively narrow second support strip in which an intermediate portion of each second contact element is rigidly embedded so that a terminal portion of each second contact element is disposed at one side of said second support strip and a contact portion of each second contact element is disposed at an opposite side of said second support strip, said second support member further having two body portions extending longitudinally from said opposite side of said second support strip to form a socket portion between them, each of said body portion aligning the contact portions of the second contact elements of respective ones of each of said groups, said socket portion being so sized and arranged as to mate with said plug portion so that the contact portions of the second contact elements electrically connect to respective contact portions of the first-named contact elements; fourth spacer means extending from each of said body portions for separating the second contact portions of each group into pairs; and fifth spacer means extending from each of said body portions for separating the second contact portions of each of said pairs, said fifth spacer means extending from respective body portion by a distance less than said fourth spacer means; said second support member and said fourth and fifth spacer means aligning said second contact elements to mate with respective ones of said first-named contact elements; said male plug connector thereby mating with said female socket connector to establish electrical connection between respective ones of the first contact elements of said male plug connector and respective ones of the second contact elements of said female socket connector.

6. Apparatus according to claim 5 wherein the terminal portions of the contact elements of each pair of contact elements are staggered along the length of the respective support member to form four rows of terminal portions.

7. Apparatus according to claim 6 further including a plurality of staggered lands supported on said one side of each said support strip to stagger said terminal portions.

8. Apparatus according to claim 7 further including sixth spacer means between adjacent lands.

9. A female socket connector of the miniature type, particularly adapted to mate with a male plug connector of the miniature type for use with printed circuit boards and the like, said female socket connector comprising: a plurality of socket-type contact elements in the form of electrically conductive sheet metal; an insulative support member rigidly supporting said contact elements in two groups, said support members forming an elongated relatively narrow support strip in which an intermediate portion of each contact element is rigidly embedded so that a terminal portion of each contact element is disposed at one side of said support strip and a contact portion of each contact element is disposed at an opposite side of said support strip, said support member further having two body portions extending longitudinally from said opposite side of said support strip to form a socket between them, each of said body portions aligning the contact portions of the contact elements of respective ones of each of said groups; first spacer means extending from each of said body portions for separating the contact portions of each group into pairs; said second spacer means extending from each of said body portions for separating the contact portions of each of said pairs, said second spacer means extending from the respective body portion by a distance less than said first spacer means; said female socket connector being adapted to mate with a male plug connector having the same number of contact elements as said female socket connector by establishing electrical connection between respective ones of the contact elements of the female socket connector and respective ones of the contact elements of the male plug connector, and being adapted to mate with a male plug connector having one-half the number of contact elements as said female socket connector by establishing electrical connection between respective pairs of the contact elements of the female socket connector and respective ones of the contact elements of the male plug connector.

10. Apparatus according to claim 9 wherein the terminal portions of the contact elements of each pair of contact elements are staggered along the length of said support member to form four rows of terminal portions.

11. Apparatus according to claim 10 further including a plurality of staggered lands supported on said one side of said support strip to stagger said terminal portions.

12. Apparatus according to claim 11 further including third spacer means between adjacent lands.

* * * * *